US005419095A

United States Patent [19]

Yohe

[11] Patent Number: 5,419,095

[45] Date of Patent: May 30, 1995

[54] BAG STRIPPING APPARATUS

[75] Inventor: Peter D. Yohe, Nescopeck, Pa.

[73] Assignee: Dyco, Nescopeck, Pa.

[21] Appl. No.: 28,790

[22] Filed: Mar. 9, 1993

[51] Int. Cl.[6] ..... B65B 43/26

[52] U.S. Cl. ..... 53/384.1; 53/381.2; 53/385.1; 414/412

[58] Field of Search ..... 53/381.2, 384.1, 385.1, 53/492; 414/411, 412

[56] References Cited

U.S. PATENT DOCUMENTS

| | | | |
|---|---|---|---|
| 4,390,135 | 6/1983 | Wakamatsu et al. | 414/411 X |
| 4,390,313 | 6/1983 | Hoehn | 53/381.2 X |
| 4,457,123 | 7/1984 | Hoehn | 53/492 |
| 4,504,183 | 3/1985 | Bennison et al. | 53/384.1 X |
| 5,069,594 | 12/1991 | Bott et al. | 414/411 X |

*Primary Examiner*—John Sipos
*Assistant Examiner*—Daniel Moon
*Attorney, Agent, or Firm*—Panitch, Schwarze, Jacobs & Nadel

[57] ABSTRACT

An apparatus for removing a bag in the form of a flexible film having an opening from about object on a planer surface includes first and second parallel cylindrical rollers movable between a first spaced-apart position and second mutually-contacting position, an apparatus for selectively moving the rollers between a first location pressing against the object and the second location a selected distance from the object, an apparatus for selectively positioning the rollers in the first and second positions, and an apparatus for rotating the rollers. Control apparatus may be provided to cause the rollers to be pressed against the object through the film while in the spaced-apart position, to move together to grip a fold of the bag between the rollers, to cause the rollers to rotate to draw the gripped fold of the film between the rollers, and to cause the rollers to be moved to a location a selected distance from the object.

9 Claims, 9 Drawing Sheets

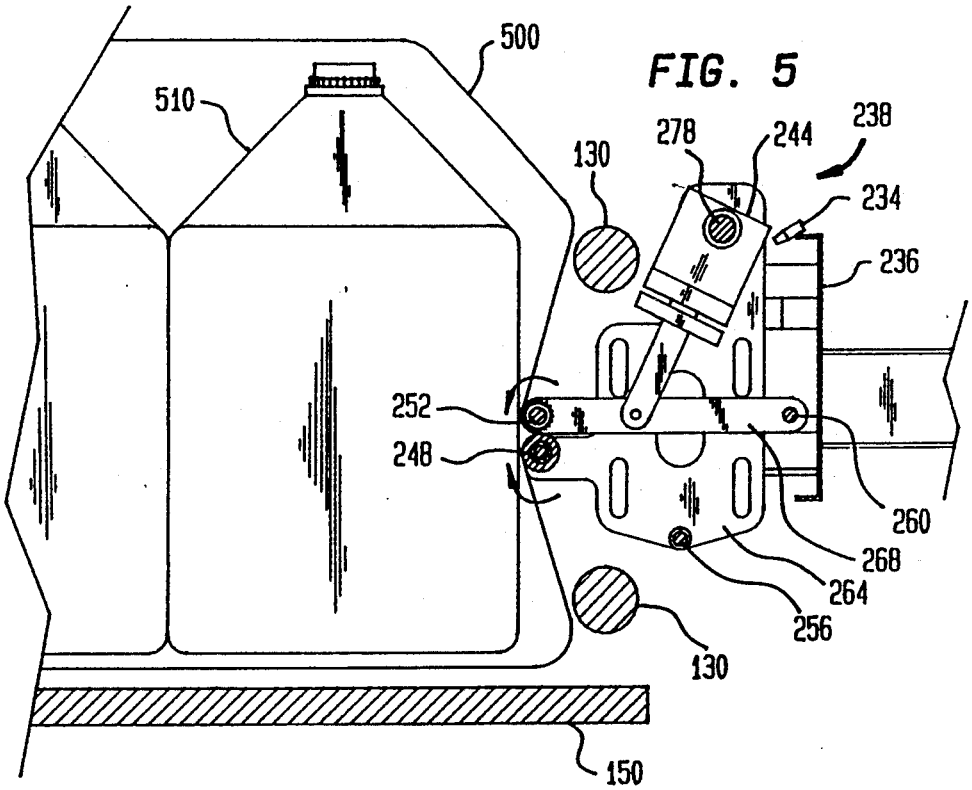
FIG. 5
FIG. 6
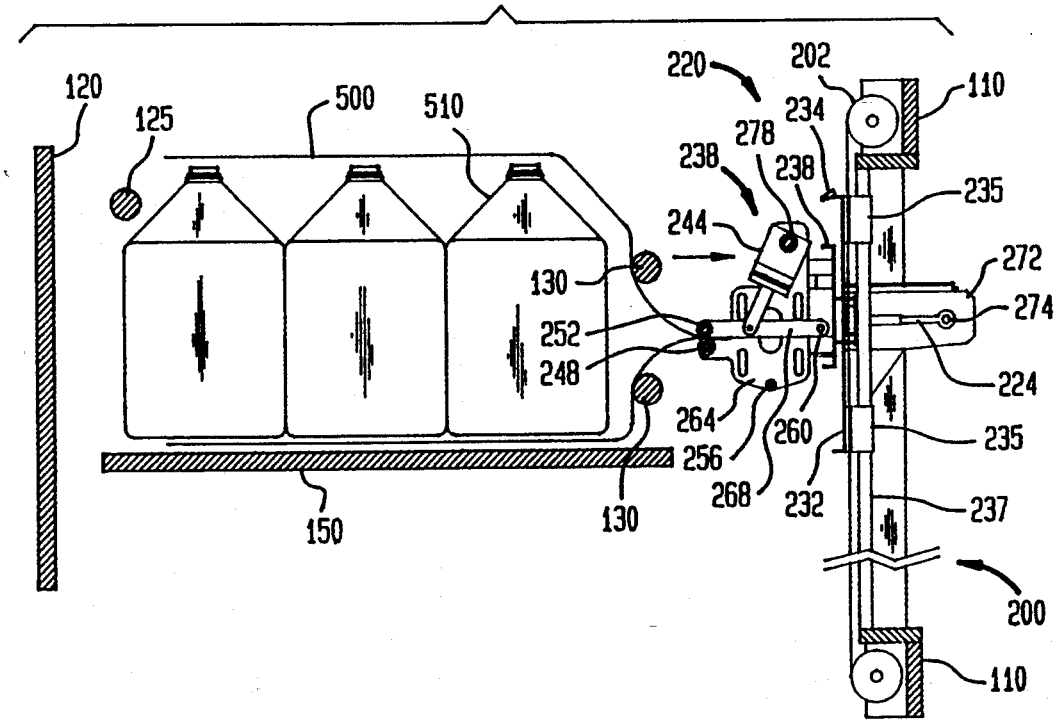

BAG STRIPPING APPARATUS

BACKGROUND OF THE INVENTION

This invention relates to the handling of articles, particularly bottles, and in particular to the removal of bags from bundles of plastic bottles.

In a bottling plant, in the beverage industry, for example, empty bottles are received in bundles wrapped in a thin plastic film which defines a bag around each bundle. The thin plastic film is provided to prevent the contamination of the bottles during shipping from the bottle manufacturer to the bottling plant. A typical bundle may have a single tier of bottles, and may be about 3 feet by 4 feet in size. The bottles in each such bundle must be removed from the bundle and eventually placed in single file for a typical bottling operation.

The removal of bags from bundles was previously accomplished by pushing the bundle against two horizontal guides, or neck rails, parallel to the direction of motion of the bundle and roughly at the height of the necks of the bottles, to define a separation between two of the rows of bottles within the bag. A knife, typically a wire heated to high temperature, then descended between the two guides to cut the bag. The separation of the bottles by the guides assured that the knife will not contact the bottles. Operators then grasped the scrap bag portions and remove them. Large trash bins were provided for receiving the scrap. The bins were then periodically removed.

Presently, most systems utilize a slitter knife between guide rails on one side and strip rails on the opposite side of the bundle. The bundle is first slit with the knife, then the bag is manually pulled off by hand through the strip rail.

These methods are slow and labor-intensive, as either one or two operators are required for stripping of bags.

One type of machine which is now available attempts to improve the speed of stripping a bag by using a specialized type of bag, having a projecting edge or tail. The machine has brushes which engage the projecting tail to pull the bag taut to allow a hot knife to cut a bag opening on one side of the bundle. However, this type of machine is unable to engage conventional plastic bags, which do not have such tails. In addition, the bag is still manually pulled off the bottles toward the opposite side from the hot knife.

It is an object of this invention to provide a method and apparatus for stripping bags from a bundle of objects automatically.

It is a further object of this invention to provide a method and apparatus for removal of bags from objects and placement of bags in a receptacle where the bags can be transferred easily to a trash or reclamation facility.

Additional objects and advantages of the invention will become apparent from the detailed description of the preferred embodiment which follows.

SUMMARY OF THE INVENTION

An apparatus for removing a bag in the form of a flexible film having an opening from about an object on a planar surface includes first and second parallel cylindrical rollers movable between a first spaced-apart position and a second mutually-contacting position, means for selectively moving the rollers between a first location pressing against the object and a second location a selected distance from the object, means for selectively positioning the rollers in the first and second positions, and means for rotating each of the rollers about its axis.

An apparatus for removing a bag having an opening from about an object supported on a planar surface having an edge and releasing the bag clear of the planar surface includes means for gripping the bag, means for moving the gripping means between a first location where the gripping means can grip the bag and a second location spaced outward from the edge of the surface, and means for applying downward force to the bag intermediate the gripping means and the edge of the surface.

An apparatus for receiving and removing a bag in the form of a flexible film from an object resting on a planar surface includes a chamber defined directly vertically downward of the surface, having a floor and a sidewall, an outlet opening defined in the sidewall, and an inlet opening defined intermediate the floor and the surface, means for removing the bag from the object and placing the bag in the chamber, a pusher disposed in the chamber, and means for causing the pusher to move through the chamber towards the outlet opening to expel bags placed on the floor through the outlet opening.

BRIEF DESCRIPTION OF THE FIGURES

FIG. 5 is an enlarged partial sectional view, similar to FIG. 4, showing a step of engaging the film in a method according to the invention.

FIG. 6 is a partial sectional view, similar to FIG. 4, showing a step of withdrawing the gripping apparatus in a method according to the invention.

DETAILED DESCRIPTION OF THE PREFERRED EMBODIMENT

Figure 1:
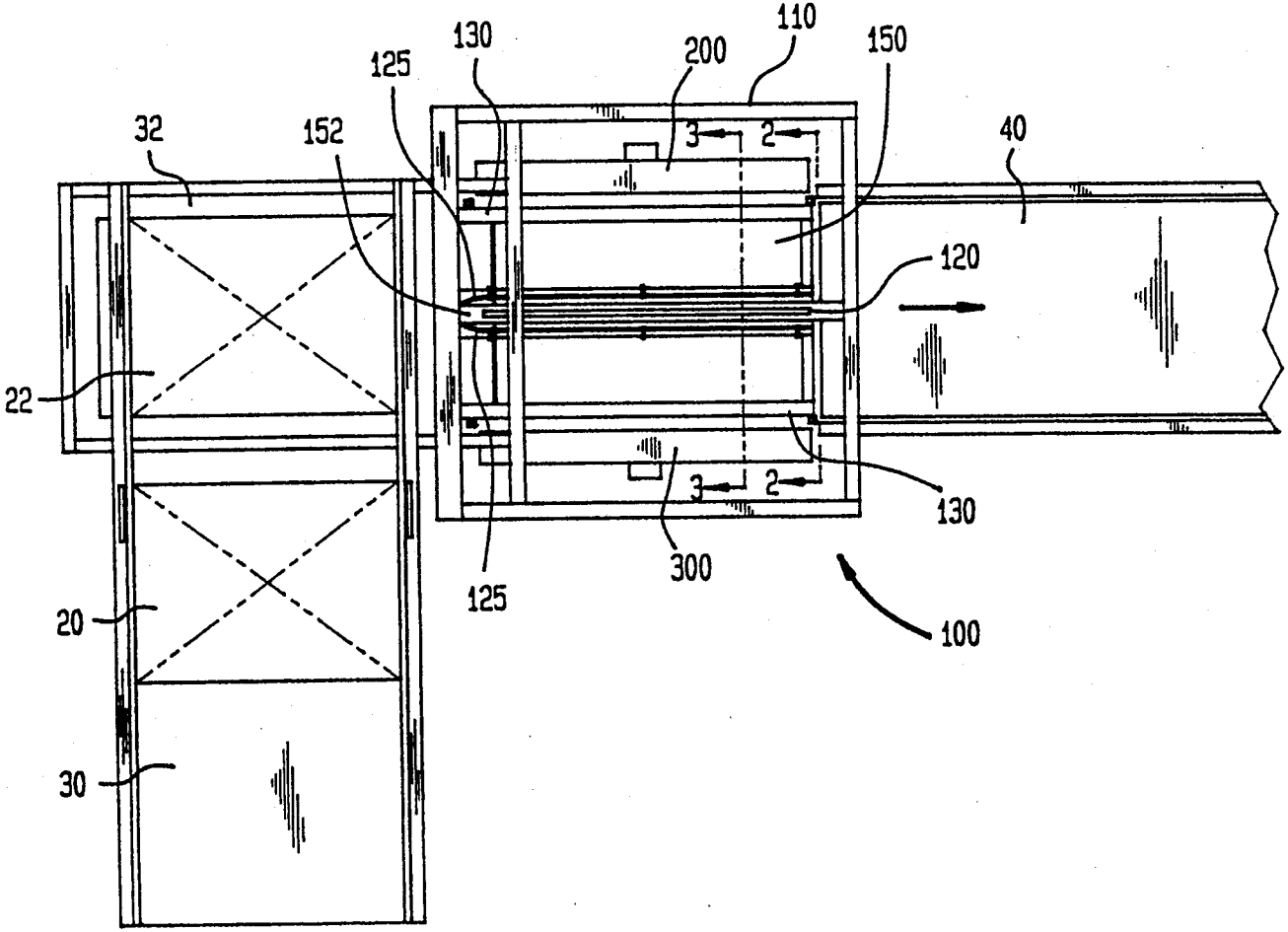
FIG. 1 is a top plan view of an apparatus according to the invention.

Referring now to FIG. 1, there is shown in top plan view a bag stripping apparatus 100 according to the invention. Bundles 20, 22 of bags are conveyed on conveyor apparatus 30 to platform 32 and pushed from platform 32 into bag stripping apparatus 100. After the step of stripping the bag is complete, the bottles are pushed by the next bundle out of apparatus 100 onto conveyor 40 and conveyed in the direction shown by the arrow. Frame 110, generally square in plan, supports bag stripping apparatus 100. Planar horizontal table 150, having a slot 152 along and through the center thereof, is provided. On a first side of table 150, there is provided first side assembly 200 and, on opposite side of table 150, there is second side assembly 300. In the center of bag stripping apparatus 100, there is provided knife 120. Knife 120 extends substantially the length of table 150 and is directly above slot 152. Knife 120 is, as is conventional, translatable in a vertical direction, and typically has a heatable wire on its lower edge to serve as a cutting member. To each side of knife 120, there are disposed neck rails 125. To each side of table 150, interior to side assemblies 200, 300, there is provided a pair of horizontal side rails 130.

Figure 2:
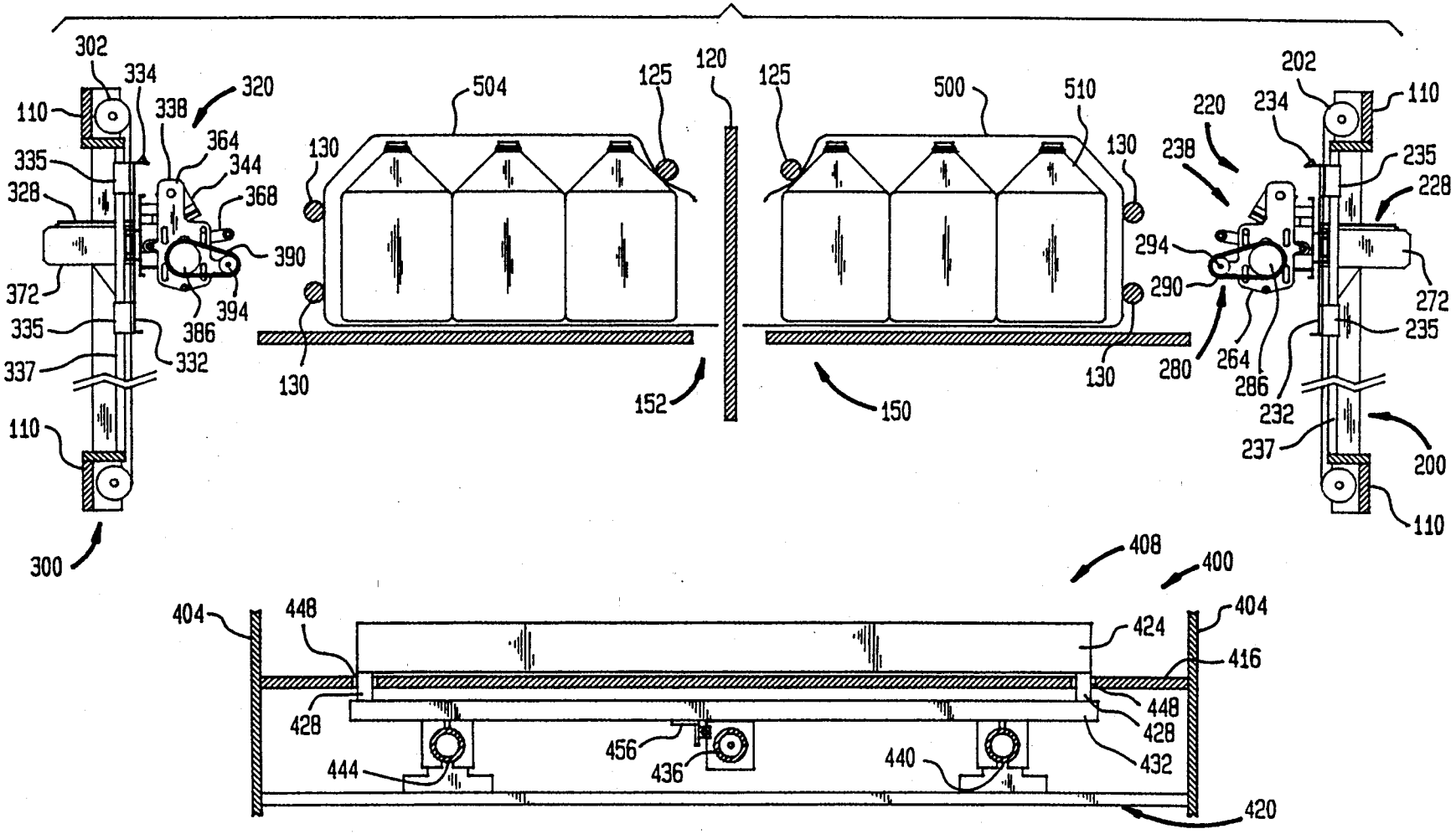
FIG. 2 is a sectional view, taken along line 2—2 of FIG. 1, of an apparatus according to the invention, with portions of the frame removed for ease of viewing.

Referring now to FIG. 2, there are shown in section first side assembly 200 and second side assembly 300 and table 150. A bundle with bag scraps 500, 504, already cut by knife 120, containing bottles 510, is shown. In this description of side assemblies 200, 300 "inner" is closer to the center of table 150, and "outer" is farther from the center of table 150. First side assembly 200 will now be described in detail. First side assembly 200 includes vertical first cable cylinder 202, which is mounted at each end thereof on frame 110, and first bag stripping assembly 220. First bag stripping assembly 220 is mounted on and rides vertically on first cable cylinder 202. First bag stripping assembly 220 includes outer frame 228, and bag gripping subassembly 238. Outer frame 228 rides vertically on cable cylinder 202 and is fixed in the horizontal direction. Bag gripping subassembly 238 is translatable horizontally with respect to outer frame 228.

Figure 3:
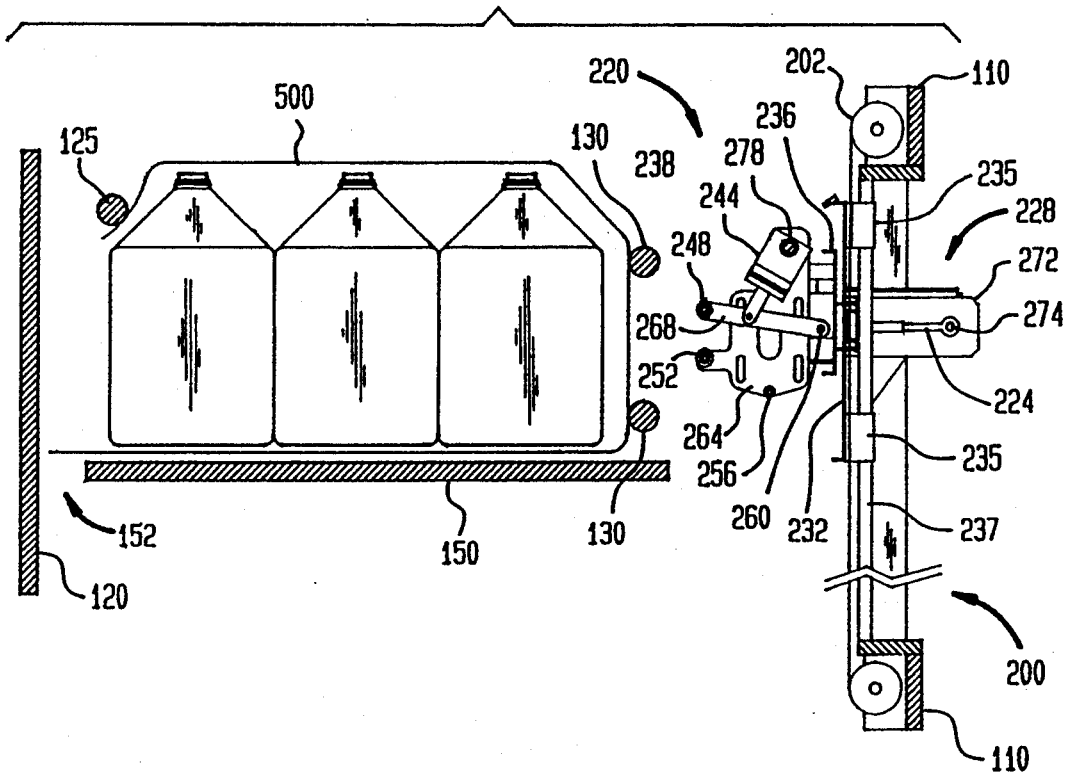
FIG. 3 is a partial sectional view, taken along line 3—3 of FIG. 1, showing an initial step in a method according to the invention.

Outer frame 228 includes outer plate 232, pivot blocks 272 and rod end mounts 274 (shown in FIG. 3). Outer plate 232, which is a generally vertical and planar metal plate, is mounted to ride vertically on cable cylinder 202. Guides 235 are attached to the outer surface of plate 232 to mount plate 232 on vertical members 237 to provide additional stability to first bag stripping assembly 220. Pivot blocks 272, which are preferably disposed in pairs, are rigidly attached to and extend horizontally outward from outer plate 232. Pivot blocks 272 may be solid pieces of machined metal. Referring now to FIG. 3, mounted intermediate each pair of pivot blocks 272 is horizontal cylinder 224. A fixed end of horizontal cylinder 224 is preferably mounted on rod end mount 274, which extends horizontally between pivot blocks 272 in each pair. Mounted to a movable inner end of horizontal cylinder 224, is inner plate 236 of bag gripping subassembly 238. Inner plate 236 is a vertical planar metal plate. Inner plate 236 supports bag gripping subassembly 238.

Bag gripping subassembly 238 has, mounted at each end thereof and attached to forward plate 236, vertical planar end plates 264. Disposed horizontally between end plates 264, and rigidly attached at each end thereto, are pivot shaft 278, bottom spacer bar 256 and rear spacer bar 260. Bottom roller 252 is also disposed horizontally, and is rotatably attached at each end to an inner projection of one of end plates 264. Rotatably attached to and projecting inward from rear spacer bar 260 are roller mounts 268. Rotatably mounted at the inner end of each roller mount 268, and extending the distance between end plates 264, is top roller 248. Film clamp cylinders 244 are disposed in a generally vertical orientation. Each film clamp cylinder 244 is pivotally attached at an upper end on pivot shaft 278, and pivotally attached at a lower end on one of roller mounts 268, intermediate top roller 248 and rear spacer bar 260. There are two film clamp cylinders 244, in a preferred embodiment.

Roller drive apparatus 280, which includes a large sprocket 286, chain 290, and small sprocket 294, drives bottom roller 252. A rotary actuator may be provided to drive large sprocket 286, chain 290, and small sprocket 294 mounted on bottom roller 252.

Bottom roller 252 and top roller 248 are preferably cylindrical, and both rollers 248, 252 preferably have grooves along the length thereof. Bottom roller 252 and top roller 248 are preferably of a high friction material. PVC has been found to be satisfactory as the roller material.

Air jet nozzles 234 are shown mounted at the top of outer plate 232. In a preferred embodiment, there are four air jet nozzles on outer plate 232. A suitable pressurized air line (not shown) is attached to each air jet nozzle 234.

Second side assembly 330 is substantially identical to first side assembly 200. Second side assembly 300 includes vertical second cable cylinder 302, mounted at each end thereof on frame 110, and second bag stripping assembly 320. Second bag stripping assembly 320 is mounted on and rides vertically on second cable cylinder 302. Second bag stripping assembly 320 includes outer frame 328 and bag gripping subassembly 338. Outer frame 328 rides vertically on cable cylinder 302 and is fixed in the horizontal direction. Bag gripping subassembly 338 is translatable horizontally with respect to outer frame 328.

Outer frame 328 includes outer plate 332, pivot blocks 372 and rod end mounts (not shown). Outer plate 332, which is a generally vertical and planar metal plate, is mounted to ride vertically on cable cylinder 302. Guides 335 are attached to the outer surface of plate 332 to mount plate 332 on vertical members 337 to provide additional stability to second bag stripping assembly 320. Pivot blocks 372, which are preferably disposed in pairs, are rigidly attached to and extend horizontally outward from rear plate 332. Pivot blocks 372 may be solid pieces of machine metal. Mounted intermediate each pair of pivot blocks 372 is a horizontal cylinder (not shown). The fixed end of the horizontal cylinder is preferably mounted on a rod end mount (not shown) extending horizontally between pivot blocks 372 in each pair. Mounted to a movable inner end of the horizontal cylinder is inner plate 336 of bag gripping subassembly 338. Inner plate 336 is a vertical planar metal plate. Inner plate 336 supports bag gripping subassembly 338.

Bag gripping subassembly 338 has, mounted in each end thereof and attached to inner plate 336, vertical planar end plates 364. Disposed horizontally between end plates 364 and rigidly attached at each end thereto, are a pivot shaft (not shown), a bottom spacer bar (not shown) and a rear spacer bar (not shown). A bottom roller (not shown) is also disposed horizontally, and is rotatably attached to each end to an inner projection of one of end plates 364, in mirror image to bottom roller 252. Rotatably attached to and projecting inward from the rear spacer bar are roller mounts 368. Rotatably mounted at the inner end of each roller mount 368, and extending the distance between end plates 264, is top roller 248. Film clamp cylinders 344 are disposed in a generally vertical orientation, pivotally attached at an upper end on the pivot shaft, and pivotally attached at a lower end to one of roller mounts 368, intermediate the top roller and the rear spacer bar.

Roller drive apparatus 380 includes large sprocket 286, chain 390 and small sprocket 394, and drives the bottom roller. A rotary actuator may be provided to drive large sprocket 386. The rollers are preferably cylindrical, and both rollers preferably have grooves along the length thereof. Air jet nozzles 334 are at the top of outer plate 332.

The operation of an apparatus of the invention will now be described, with reference only to first side assembly 200. It will be understood that the operation of second side assembly 300 is identical.

Referring now to FIG. 3, it will be seen that gripping subassembly 238 is in its outer position, as horizontal cylinder 224 is retracted. Top roller 248 is disposed in its upper position, as film clamp cylinder 244 is retracted. As a result, there is provided a space between top roller 248 and bottom roller 252. Top roller 248 and bottom roller 252 are in a first, spaced-apart, position.

Figure 4:
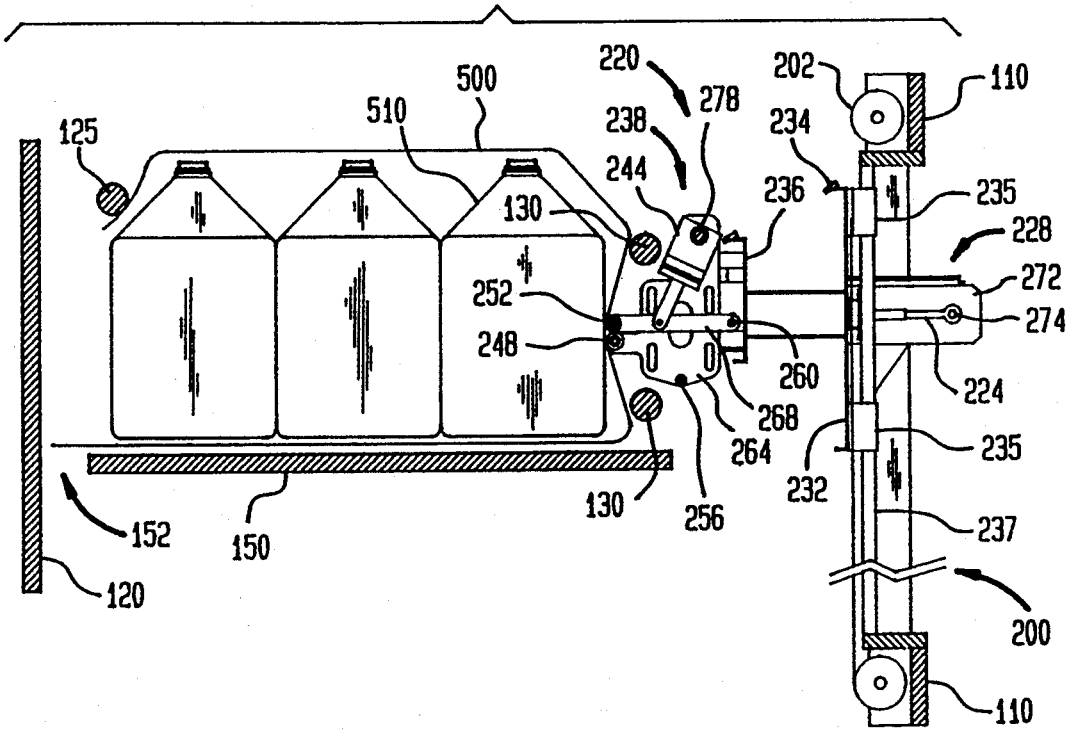
FIG. 4 is a partial sectional view, similar to FIG. 3, showing a step of initially grasping the film in a method according to the invention.

Referring now to FIG. 4, top roller 248 and bottom roller 252 engage film 500 and press against the outer row of bottles 510. This is done by moving bag gripping subassembly 238 inward of outer frame 228. This is specifically accomplished in this embodiment by causing horizontal cylinder 224 to extend. Top roller 248 and bottom roller 252 are thus moved to a first location pressing against bottles 510, while in the first, spaced-apart, position. Top roller 248 then engages bottom roller 252. As top roller 248 is mounted at the inner end of roller mount 268, top roller 248 describes an arc as it moves from its upper position to engage bottom roller 252. Top roller 248 is moved by extension of film clamp cylinders 244. In moving to engage bottom roller 252, top roller 248 contacts bag 500 along a horizontal line. As top roller 248 is of a high friction material, top roller 248 will pull bag 500 downward along the contact line. As a result, a small fold of the film of bag 500 is caught between top roller 248 and bottom roller 252. Top roller 248 and bottom roller 252 have now been positioned in a second, mutually-engaging, position.

Referring now to FIG. 5, top roller 248 and bottom roller 252 rotate so that their surfaces in contact move outward. As a result, the fold of the film of bag 500 caught between top roller 248 and bottom roller 252 is pulled outward between top roller 248 and bottom roller 252. Rotation of the rollers is accomplished by roller drive apparatus 280, which drives bottom roller 252. As rollers 248, 252 are grooved, and are in engagement, the rotation of bottom roller 252 causes top roller 248 to rotate as well. In roller drive apparatus 280, a rotary actuator (not shown) turns large sprocket 248, which drives chain 290, which is engaged with small sprocket 294 at one end of bottom roller 252. Rollers 248,252 turn through a selected rotation. In a preferred embodiment, the selected rotation may be 500 degrees. The direction of rotation of rollers 248, 252 is indicated by the arrows in FIG. 5.

Referring now to FIG. 6, top roller 248 and bottom roller 252, continuing to grip the fold of bag 500, are moved away from bottles 510. The direction of motion is shown by the arrow in FIG. 6. The step of moving away from bottles 510 is accomplished by movement of bag gripping subassembly 238 outward to outer frame 228. This is accomplished by deactivation and retraction of horizontal cylinder 224.

Figure 7:
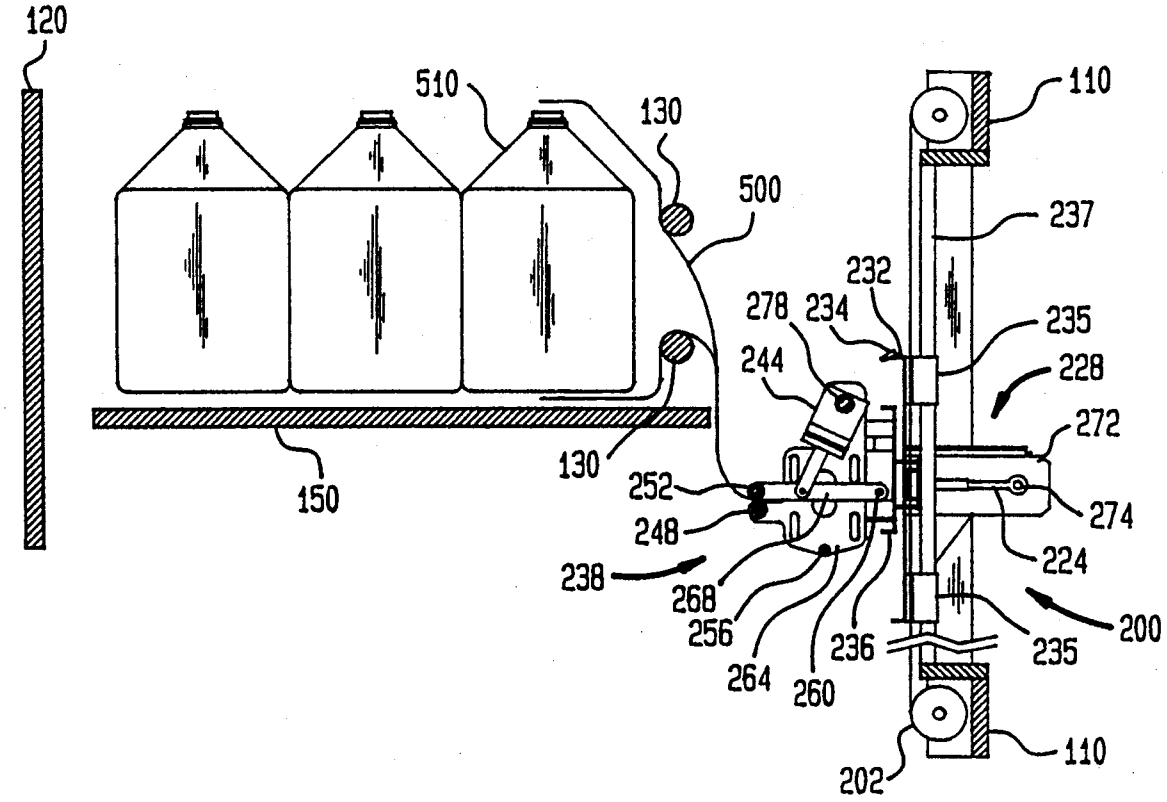
FIG. 7 is a partial sectional view, similar to FIG. 6, showing a step of withdrawing a leading edge of the bag below the level of a support table.

Referring now to FIG. 7, first bag stripping assembly 220 has now been partially lowered by action of first cable cylinder 202. When first bag stripping assembly 220 has reached its lower position, shown in FIG. 8, the leading edge of bag 500 is below the edge of table 150. The trailing edge of bag 500, however, is at the level of table 150. At this step, rollers 248, 252 have been moved to a second location a selected distance from bottles 510. The second location is outward of the edge of table 150.

Figure 8:
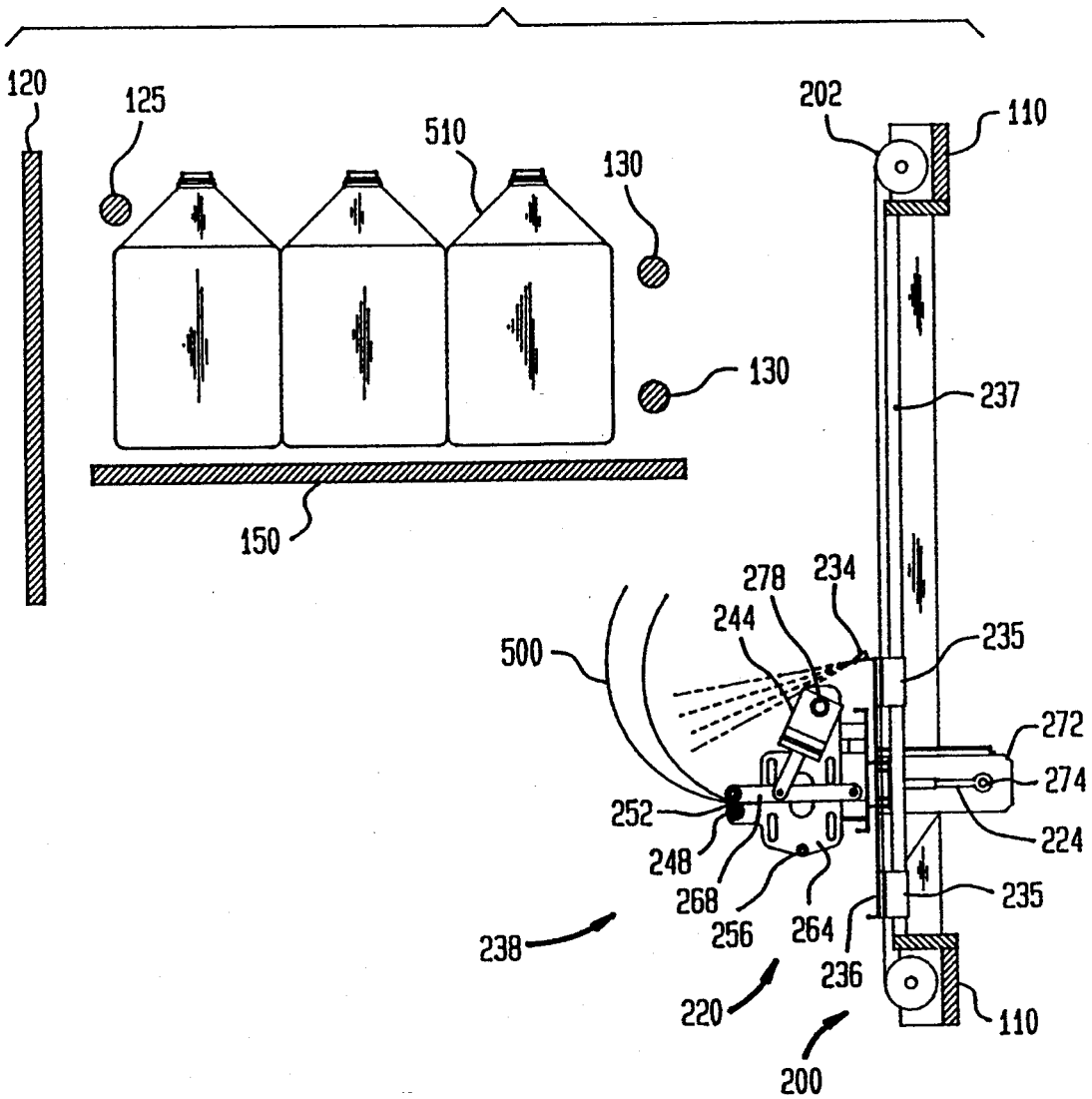
FIG. 8 is a partial sectional view, similar to FIG. 7, showing a step of applying force on the bag.
Figure 9:
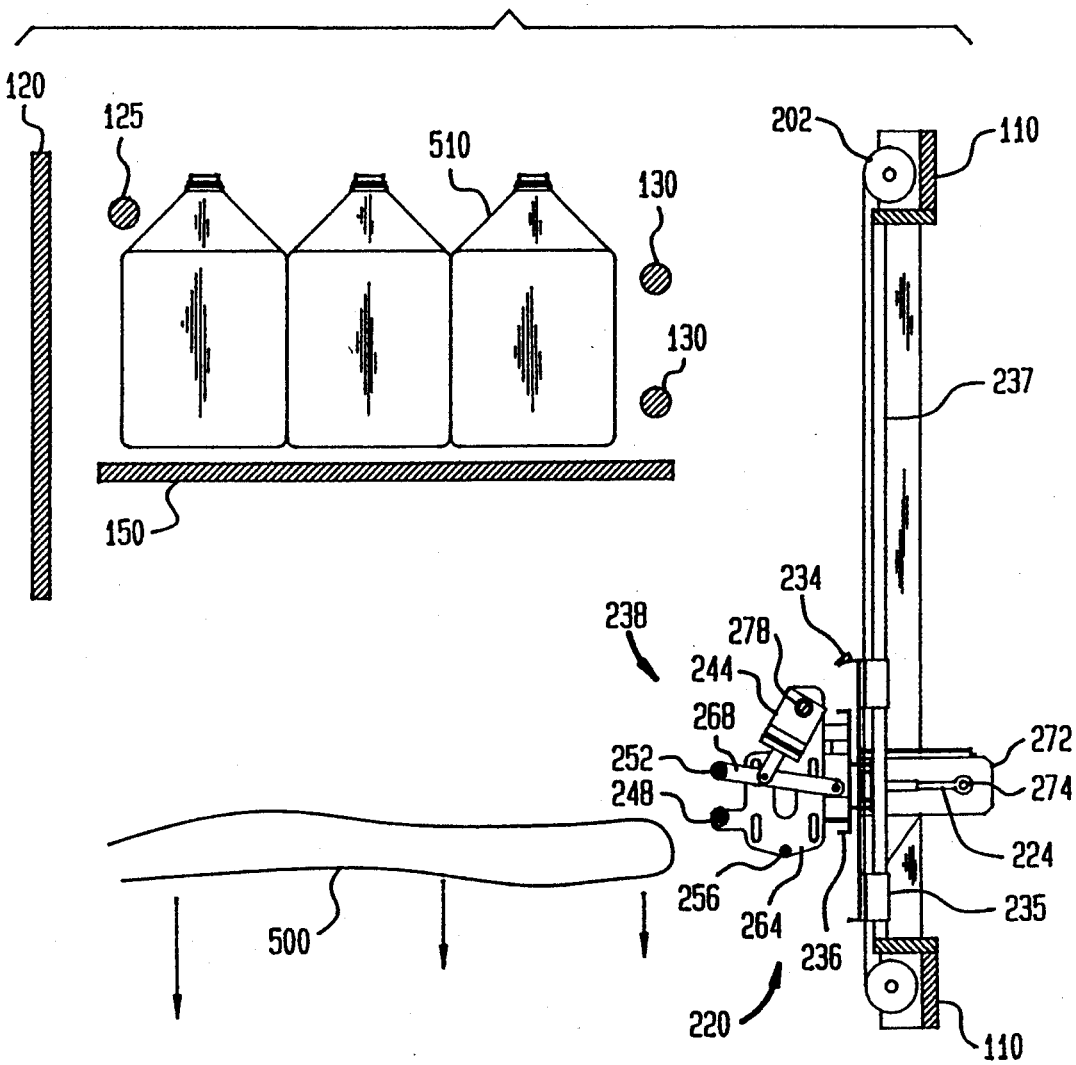
FIG. 9 is a partial sectional view, similar to FIG. 8, showing a step of releasing the bag.

Referring now to FIG. 8, air jets 234 are activated. Air jets 234 expel a stream of air that strikes bag 500 intermediate rollers 248,252, which securely grip the leading edge of bag 500, and the edge of table 150. The application of force on the bag intermediate the edge of table 150 and rollers 248, 252, causes the trailing edge of bag 500 to be forced clear of the edge of table 150, and away from bag stripping assembly 220 under table 150 as shown in FIG. 9. The application of force assures that bag 500 does not fall onto bag stripping assembly 220 when the bag clears the edge of table 150.

Referring now to FIG. 9, once bag 500 is disposed under table 150, each of rollers 248,252 rotate about its axis so as to expel the leading edge of film 500. This is accomplished by roller drive apparatus 280 driving bottom roller 252 in the direction opposite from that shown in FIG. 5. Upon completion of the rotation of the rollers, top roller 248 is moved upward to release the engagement of rollers 248, 252. This is accomplished by retraction of film clamp cylinders 244. Film 500 is then clear of bag stripping assembly 220. Film 500 then falls downward into scrap chamber 400, in the direction shown in the arrows in FIG. 9.

Figure 10:
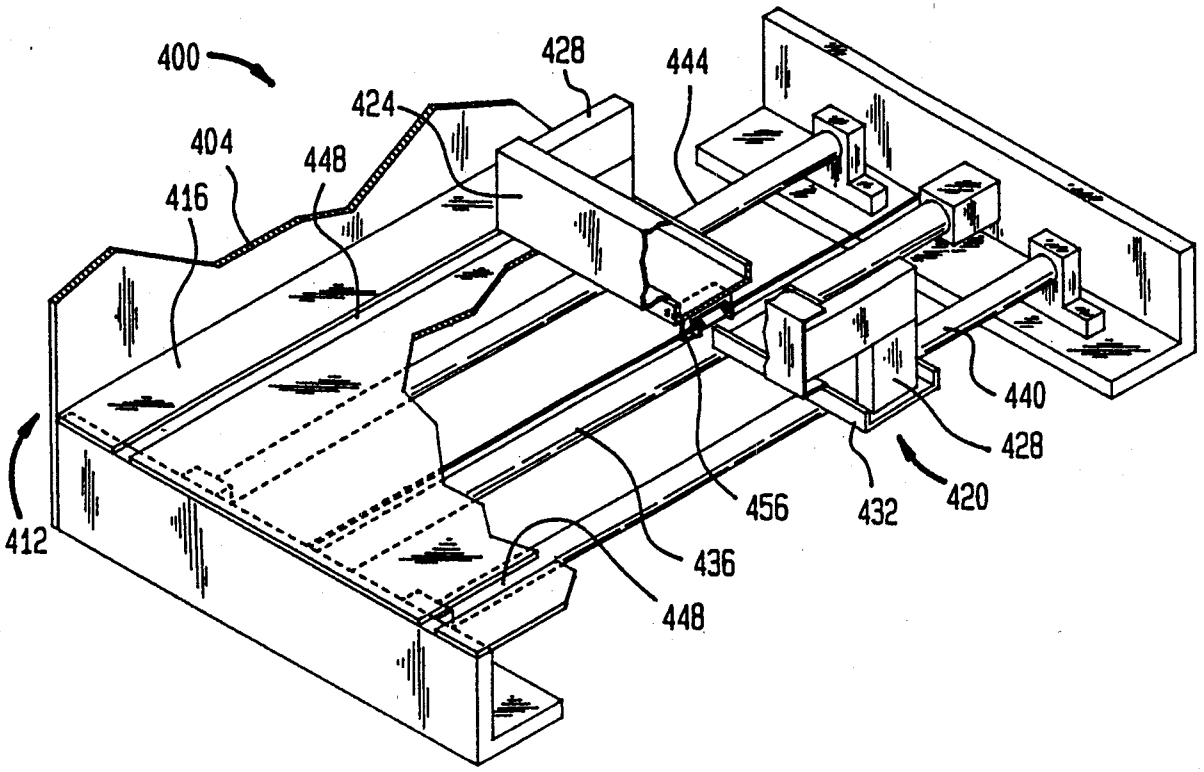
FIG. 10 is an isometric view, with partial cutaway, showing a pusher assembly for use in an apparatus according to invention.

Referring now to FIGS. 2 and 10, there is shown scrap chamber 400, having pusher assembly 420 therein. Scrap chamber 400 is a chamber defined by sidewall 404 and chamber floor 416. Scrap chamber 400 has a top inlet opening 408 and a side outlet opening 412.

Pusher assembly 420 includes vertical planar pusher plate 424, supported above chamber floor 416 by pusher uprights 428, which extend through elongated slots 448 defined in chamber floor 416. Pusher uprights 428 are supported on horizontal pusher base plate 432. Pusher base plate 432 in turn is slidably supported on elongated shafts 440, 444. There is provided pusher cable cylinder 436 parallel to shafts 440, 444, and slots 448. Connector 456 affixes base plate 432 to the cable of cable cylinder 436. By operation of cable cylinder 436, employing appropriate pressurized air lines (not shown), pusher plate 424 may be caused to reciprocate across floor 416 of chamber 400.

In operation, bag scrap 500 released from rollers 248, 252, falls into chamber 400 and comes to rest on floor 416. A selected period of time after the release of the bag by rollers 248, 252, pusher cable cylinder 436 is activated to cause pusher plate 424 to travel across floor 416, thereby pushing bag scrap 500 to side outlet opening 412. As desired, there may be provided, for example, a pneumatic chute, or a receptacle to receive scraps pushed through side outlet opening 412.

Figure 11:
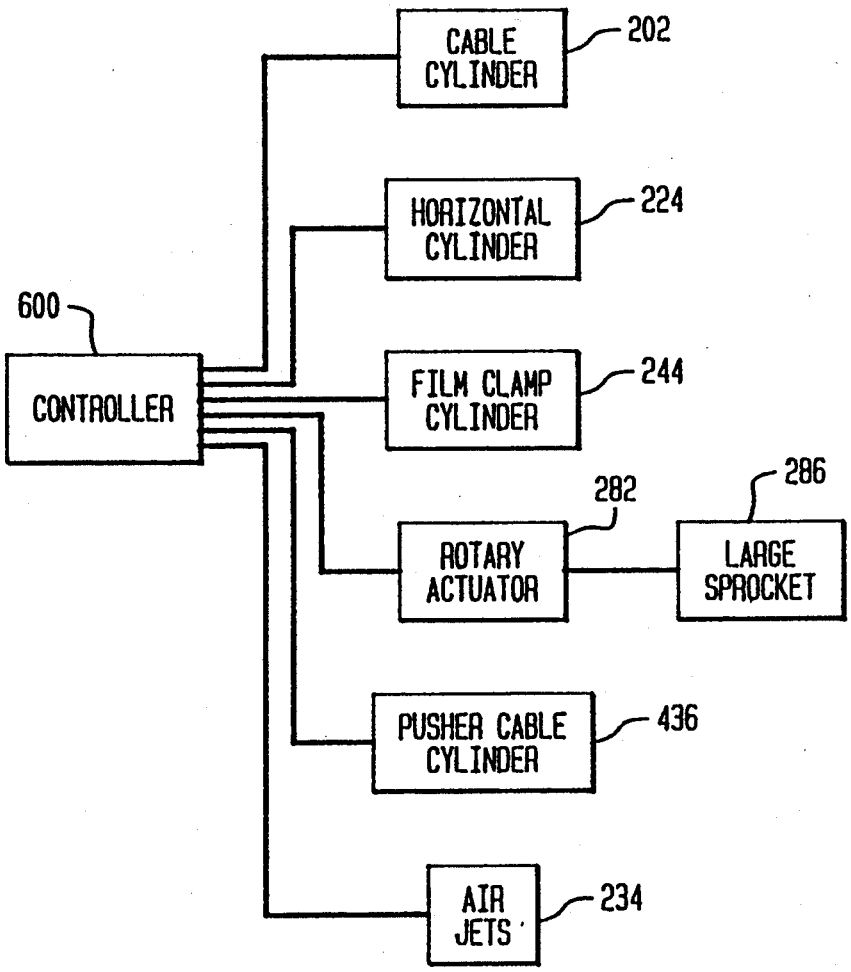
FIG. 11 is a block diagram of a control system in an apparatus of the invention.

Referring now to FIG. 11, there is depicted, in a block diagram, controller 600, coupled to cable cylinder 202, horizontal cylinder 224, film clamp cylinder 244, rotary actuator 282 coupled to large sprocket 286, and pusher cable cylinder 436. In operation, controller 600 controls apparatus 100 as follows. Controller 600 will cause horizontal cylinder 224 to extend. This is done, in a preferred embodiment, by controller 600 providing a signal to a solenoid to open an air valve to cause horizontal cylinder 224 to extend. After horizontal cylinder 224 is fully extended, controller 600 will cause film clamp cylinder 244 to extend. In a preferred embodiment, a first limit switch is provided, that is closed when horizontal cylinder 224 is fully extended. When this first limit switch is closed, a signal is provided to controller 600; controller 600 then causes film clamp cylinder 244 to extend, preferably by providing a signal to a solenoid to open a valve to a pressurized air line. A second limit switch may be provided, which is closed when film clamp cylinder 244 is fully extended. This second limit switch provides a signal to controller 600. After film clamp cylinder 244 is extended, controller 600 causes rotary actuator 282 to rotate in a first direction. In a preferred embodiment, rotary actuator 282 is caused, by closing a switch to provide electrical power, to operate for a pre-selected period of time, to accomplish a pre-selected rotation. After rotary actuator 282 has rotated, controller 600 activates horizontal cylinder 224 to retract. This is preferably done by switching a valve to cause horizontal cylinder 224 to retract. In a preferred embodiment, a third limit switch is closed when horizontal cylinder 224 is fully retracted. When a signal is received by controller 600 from this third limit switch, controller 600 activates cable cylinder 202, by providing a signal to a solenoid to open a suitable valve, to cause first bag stripping assembly 220 to be lowered. In a preferred embodiment, controller 600 maintains the valve open until a fourth limit switch is closed, to indicate that cable cylinder 202 has brought first bag stripping assembly to a selected lowered position. Controller 600 then opens an appropriate valve to cause air jets 234 to activate. In a preferred embodiment, controller 600 causes the air jets 234 to be activated for pre-selected period of time and after a selected interval, while air jets 234 are still activated, controller 600 preferably causes rotary actuator 282 to operate in a reverse direction, to expel the film. This is done by closing a switch for a selected period of time. After the switch is open, and rotary actuator 282 has stopped, controller 600 opens a valve to cause film clamp cylinder 244 to retract. In a preferred embodiment, air jets 234 are then closed. Controller 600 then causes cable cylinder 202 to operate in a reversed direction, to raise bag stripping assembly 220 to an upper position. Controller 600 may be, for example, any one of a large number of conventional micro-computers.

It will be appreciated that there are considerable variations that can be accomplished in a method and apparatus according to the invention without departing from its scope. As a result, although a preferred embodiment of a method and apparatus of the invention have been described above, it is emphasized that the invention is not limited to a preferred embodiment and that there exists other alternative embodiments that are fully encompassed within the invention's scope, which is intended to be limited only by the scope of the appended claims.

What is claimed is:

1. An apparatus for removing a bag in the form of a flexible film having an opening from about an object on a planer surface, comprising:

(a) first and second parallel cylindrical rollers movable between a first spaced-apart position and a second mutually-contacting position for gripping the bag;

(b) means for selectively moving said rollers in a horizontal direction from a first location pressing against said object to a second location a selected horizontal distance from said object;

(c) means for selectively disposing said rollers in said first and said second positions; and (d) means for rotating each of said rollers about its axis for removing the bag.

2. The apparatus of claim 1, further comprising control means for (i) causing said roller moving means to move said rollers to said first location while said rollers are in said first position to press said object through said film; (ii) after said rollers have been moved to said first location, causing said roller positioning means to dispose said rollers in said second position to grip a fold of said film between said rollers, (iii) after said rollers have gripped said fold of said film, causing said rotating means to rotate said rollers to draw said gripped fold of said film between said rollers; and (iv) after said rollers have been rotated, causing said roller moving means to move said rollers to said second location.

3. The apparatus of claim 2, further comprising means for creating said fold of said film for gripping by said rollers.

4. The apparatus of claim 1, wherein at least one of said rollers is provided with a high-friction surface.

5. The apparatus of claim 1, wherein said rollers are supported on a bag stripping subassembly, said first roller rotatably supported on said bag stripping subassembly to rotate on its axis, said second roller rotatably supported on at least one roller mount, said roller mount rotatably mounted on said bag stripping subassembly, and said means for disposing said rollers comprising a cylinder for rotating said roller mount.

6. An apparatus for removing a bag having an opening from an object supported on a planar surface having an edge and releasing said bag clear of the planer surface, comprising:

(a) means for gripping said bag;

(b) means for moving said gripping means between a first location where said gripping means can grip said bag and a second location spaced outward from said edge of said planar surface; and (c) means for applying downward force to said bag intermediate said gripping means and said edge of said planar surface while said bag is gripped by said gripping means.

7. The apparatus of claim 6, further comprising control means for (i) causing said gripping means to grip said bag while said gripping means is in said first location; (ii) after said gripping means has gripped said bag, causing said moving means to move said gripping means to said second location beyond an edge of said planar surface, so that a trailing edge of said bag is supported on said planar surface; (iii) after said moving means has moved said gripping means to said second location, causing said force applying means to apply downward force to said bag intermediate said gripping means and said edge of said planar surface; and (iv) causing said gripping means to release said bag.

8. The apparatus of claim 6, wherein said means for gripping said bag comprises first and second parallel cylindrical rollers movable between a first spaced-apart position and a second, mutually-contacting position, and means for selectively disposing said rollers in said first and second positions.

9. The apparatus of claim 6, wherein said force applying means comprises means for directing an air stream.

* * * * *